US010465964B2

(12) United States Patent
Kato et al.

(10) Patent No.: US 10,465,964 B2
(45) Date of Patent: Nov. 5, 2019

(54) REFRIGERATION CYCLE APPARATUS AND CONTROL METHOD OF REFRIGERATION CYCLE APPARATUS

(71) Applicants: Yohei Kato, Tokyo (JP); Kiyoshi Yoshimura, Tokyo (JP)

(72) Inventors: Yohei Kato, Tokyo (JP); Kiyoshi Yoshimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1175 days.

(21) Appl. No.: 14/653,295

(22) PCT Filed: Dec. 26, 2012

(86) PCT No.: PCT/JP2012/083709

§ 371 (c)(1),
(2) Date: Jun. 18, 2015

(87) PCT Pub. No.: WO2014/102940

PCT Pub. Date: Jul. 3, 2014

(65) Prior Publication Data

US 2015/0330689 A1 Nov. 19, 2015

(51) Int. Cl.
*F25B 49/02* (2006.01)
*F25B 13/00* (2006.01)

(52) U.S. Cl.
CPC ..... *F25B 49/022* (2013.01); *F25B 13/00* (2013.01); *F25B 49/02* (2013.01);
(Continued)

(58) Field of Classification Search
CPC .. F25B 2700/21152; F25B 2700/21162; F25B 2600/2513; F25B 2600/2511;
(Continued)

(56) References Cited

U.S. PATENT DOCUMENTS 4,620,424 A * 11/1986 Tanaka ..... F25B 41/062 62/222
7,213,404 B2 * 5/2007 Chin ..... F25B 49/02 62/222
(Continued)

FOREIGN PATENT DOCUMENTS

JP 60-140075 A 7/1985
JP 04-222353 A 8/1992
(Continued)

OTHER PUBLICATIONS

Office Action dated May 12, 2016 issued in corresponding CN patent application No. 201280078035.6 (and English translation).
(Continued)

*Primary Examiner* — Jianying C Atkisson
*Assistant Examiner* — Meraj A Shaikh
(74) *Attorney, Agent, or Firm* — Posz Law Group, PLC

(57) ABSTRACT

A refrigeration cycle apparatus includes a discharge temperature sensor that detects a discharge temperature of refrigerant discharged from a compressor, and a controller that controls the opening degree of an expansion valve. The controller computes an amount of variation of the discharge temperature resulting from varying the opening degree of the expansion valve, computes a ratio of the amount of variation of the discharge temperature to an amount of variation of the opening degree of the expansion valve, and determines the opening degree to be set to the expansion valve on the basis of the opening degree of the expansion valve that causes a change of the ratio.

12 Claims, 8 Drawing Sheets

(52) U.S. Cl.
CPC ..... *F25B 2313/0314* (2013.01); *F25B 2313/0315* (2013.01); *F25B 2400/053* (2013.01); *F25B 2400/054* (2013.01); *F25B 2600/2513* (2013.01); *F25B 2700/21152* (2013.01)

(58) Field of Classification Search
CPC ..... F25B 2500/08; F25B 2500/28; G05B 23/0205; G05B 23/0218
See application file for complete search history.

(56) References Cited

U.S. PATENT DOCUMENTS

| | | | | |
|---|---|---|---|---|
| 2006/0021362 | A1* | 2/2006 | Sadegh | F25B 49/005 62/129 |
| 2010/0205987 | A1* | 8/2010 | Okazaki | F25B 9/008 62/190 |
| 2017/0016661 | A1* | 1/2017 | Burns | F25B 49/02 |

FOREIGN PATENT DOCUMENTS

| | | | |
|---|---|---|---|
| JP | 07-035421 | A | 2/1995 |
| JP | 2003-294295 | A | 10/2003 |
| JP | 2011-214736 | A | 10/2011 |

OTHER PUBLICATIONS

Extended European Search Report dated Jul. 20, 2016 in the corresponding EP application No. 12890768.0.
International Search Report of the International Searching Authority dated Apr. 2, 2013 for the corresponding international application No. PCT/JP2012/083709 (and English translation).
Office Action dated Jan. 5, 2016 issued in corresponding JP patent application No. 2014-553945 (and English translation).

* cited by examiner (a)

(b)

(c)

REFRIGERATION CYCLE APPARATUS AND CONTROL METHOD OF REFRIGERATION CYCLE APPARATUS

CROSS REFERENCE TO RELATED APPLICATION

This application is a U.S. national stage application of International Application No. PCT/JP2012/083709 filed on Dec. 26, 2012, the disclosure of which is incorporated by reference.

TECHNICAL FIELD

The present invention relates to a refrigeration cycle apparatus including a compressor, a condenser, an expansion valve with variable opening degree, and an evaporator which are connected in a loop via a pipe so as to allow refrigerant to circulate, and a control method of the refrigeration cycle apparatus.

BACKGROUND ART

In conventional refrigeration cycle apparatuses, an electric expansion valve is fully opened when discharge-side temperature of a compressor exceeds an upper temperature limit, and the opening degree that was set before fully opening is stored in a memory. Then the expansion valve is set to an opening degree one step larger than the stored opening degree when the discharge-side temperature falls to a lower temperature limit. Through the above arrangement the expansion valve can be set to a predetermined opening degree without allowing abnormal increase of the discharge-side temperature of the compressor (see, for example, Patent Literature 1).

CITATION LIST

Patent Literature

Patent Literature 1: Japanese Unexamined Patent Application Publication No. 60-140075 (page 2)

SUMMARY OF INVENTION

Technical Problem

Conventionally, the expansion valve is controlled on the basis of comparison between the discharge temperature detected by a temperature sensor and the upper temperature limit. However, in the case where the value detected by the temperature sensor is inaccurate, it is not possible to appropriately control the expansion valve. When the opening degree of the expansion valve is not properly controlled, coefficient of performance (COP) and capacity are degraded, problematically.

Setting a target temperature taking into account the error of the value detected by the temperature sensor might be a solution, however, the error of the value detected by the temperature sensor may individually vary when a plurality of refrigeration cycle apparatuses are manufactured. For example, when the temperature sensor is mounted to the refrigerant pipe in the manufacturing process, the condition of installation may vary. In addition, the resolution and accuracy of the temperature sensor itself individually varies. Therefore, it is difficult to set a target temperature in each individual apparatus taking into account the error of the value detected by the temperature sensor.

Another solution might be detecting a degree of subcooling (SC) at the outlet of the condenser independent from the detection of the discharge temperature of the compressor, to thereby control the opening degree of the expansion valve. However, when the refrigerant flowing out of the condenser is not subcooled, for example in a low-load operation, it is not possible to appropriately control the expansion valve. In particular, when the pipe connecting between the outdoor unit and the indoor unit is prolonged the amount of the refrigerant becomes insufficient, and therefore the mentioned drawback appears more prominently.

The present invention has been accomplished in view of the foregoing problem, and provides a refrigeration cycle apparatus capable of improving COP and capacity regardless of an error of a value detected by a temperature sensor and an operating condition of the refrigeration cycle apparatus, and a control method of the refrigeration cycle apparatus.

Solution to Problem

The present invention provides a refrigeration cycle apparatus including a compressor, a condenser, an expansion valve with variable opening degree, and an evaporator which are connected in a loop via a pipe so as to allow refrigerant to circulate. The apparatus includes a temperature sensor that detects a discharge temperature of the refrigerant discharged from the compressor, and a controller that controls the opening degree of the expansion valve. The controller computes an amount of variation of the discharge temperature resulting from varying the opening degree of the expansion valve, computes a ratio of the amount of variation of the discharge temperature to an amount of variation of the opening degree of the expansion valve, and determines the opening degree to be set to the expansion valve based on the opening degree of the expansion valve that causes a change of the ratio.

Advantageous Effects of Invention

With the configuration of the present invention, COP and capacity can be improved regardless of an error of a value detected by a temperature sensor and an operating condition of the refrigeration cycle apparatus.

DESCRIPTION OF EMBODIMENTS

Embodiment 1

<Configuration of Refrigeration Cycle Apparatus>

Figure 1:
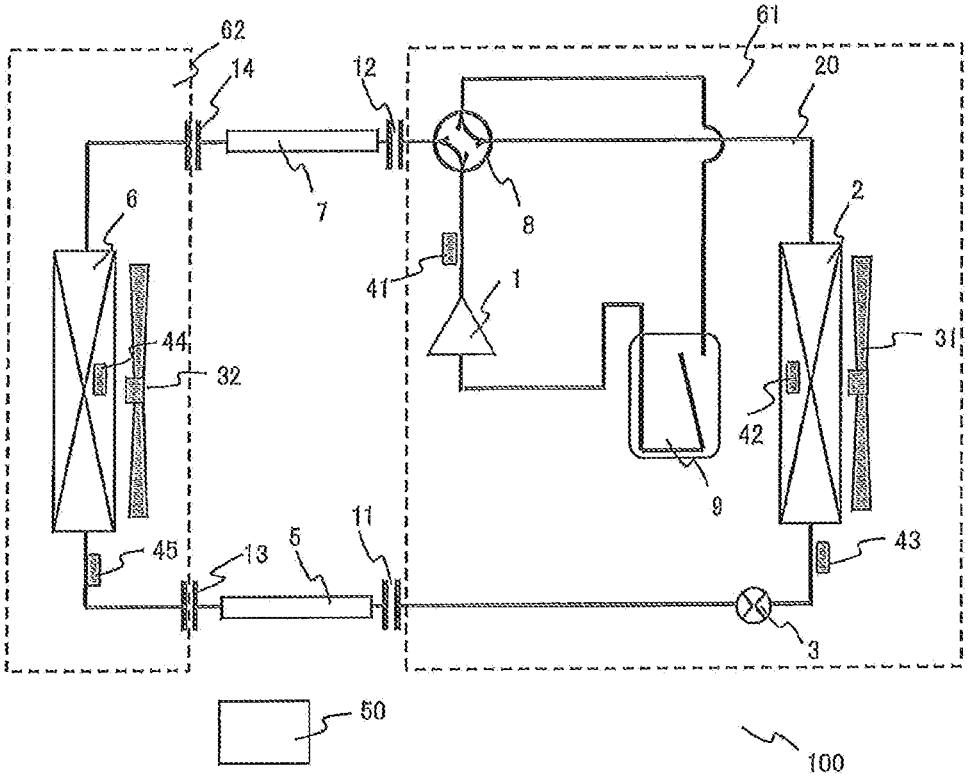
FIG. 1 is a schematic diagram showing a configuration of a refrigeration cycle apparatus according to Embodiment 1 of the present invention.

FIG. 1 is a schematic diagram showing a configuration of a refrigeration cycle apparatus according to Embodiment 1 of the present invention.

As shown in FIG. 1, the refrigeration cycle apparatus 100 includes an outdoor unit 61, and an indoor unit 62 separated from the outdoor unit 61. The outdoor unit 61 and the indoor unit 62 are connected to each other via a liquid pipe 5 and a gas pipe 7, so as to constitute a refrigerant circuit 20 to be subsequently described. The outdoor unit 61 transmits heat to and removes heat from a heat source, for example atmospheric air. The indoor unit 62 transmits heat to and removes heat from a load, for example indoor air. Although only a single indoor unit 62 is illustrated in FIG. 1, a plurality of indoor units may be provided.

<Configuration of Outdoor Unit>

The outdoor unit 61 includes a compressor 1, a four-way valve 8 serving as a flow switching device, an outdoor heat exchanger 2 that exchanges heat with a heat source-side medium, an accumulator 9 serving as a refrigerant buffer container, and an expansion valve 3 serving as a depressurizing device, which are connected via refrigerant pipes. The outdoor unit 61 also includes an outdoor fan 31 that transports the heat source-side medium such as atmospheric air or water to the outdoor heat exchanger 2. Hereunder, each of the devices constituting the outdoor unit 61 will be described by turns.

(Compressor)

The compressor 1 is for example a hermetic compressor, and configured to vary the rotation speed with an inverter according to an instruction from a controller 50. By controlling the rotation speed of the compressor 1 so as to control the flow rate of the refrigerant circulating in the refrigerant circuit 20, the heat transmission or heat removal by the indoor unit 62 can be controlled so as to maintain, for example an indoor air temperature when the load is the indoor air, at an appropriate level.

(Four-Way Valve)

The four-way valve 8 serves to switch the flow path of gas refrigerant discharged from the compressor 1 between a path to the outdoor heat exchanger 2 and a path to the indoor heat exchanger 6. Switching the flow path with the four-way valve 8 allows, for example, the outdoor heat exchanger 2 to serve as a condenser (radiator) or as an evaporator.

(Outdoor Heat Exchanger)

The outdoor heat exchanger 2 is for example a fin tube heat exchanger, and exchanges heat between the heat source-side medium, namely outdoor air, supplied from the outdoor fan 31 and the refrigerant. The heat source-side medium subjected to heat exchange with the refrigerant in the outdoor heat exchanger 2 is not limited to outdoor air (air), but for example water or anti-freeze fluid may be employed as heat source. In this case, a plate heat exchanger is employed as the outdoor heat exchanger 2, and a pump is employed as the heat source-side transport device, instead of the outdoor fan 31. Alternatively, the heat exchange pipe of the outdoor heat exchanger 2 may be buried in the ground to utilize the geothermal energy, to thereby secure a heat source that provides a constant temperature all the year round.

(Expansion Valve)

The expansion valve 3 is configured to vary the opening degree according to the instruction from the controller 50. The expansion valve 3 may be constituted of an electronically controlled expansion valve (linear expansion valve, LEV), for example. With a change in opening degree of the expansion valve 3, flow path resistance can be changed. The setting process of the opening degree of the expansion valve 3 will be subsequently described.

(Accumulator)

The accumulator 9 serves to separate gas-liquid two-phase refrigerant flowing out of the evaporator into gas and liquid. Accordingly, the liquid refrigerant can be prevented from being sucked into the compressor 1 by causing the refrigerant to pass through the accumulator 9 before flowing into the compressor 1. Thus, the accumulator 9 contributes to improving reliability by prevention of liquid compression in the compressor 1 and shaft seizure due to a decline in oil concentration in the compressor 1. In addition, the accumulator 9 serves to separate refrigerating machine oil to be returned to the compressor 1. For this purpose, a hole and a pipe for returning a necessary amount of refrigerating machine oil to the compressor 1 are provided in a suction pipe (not shown) in the accumulator 9, and when the refrigerating machine oil is dissolved in the refrigerant a small amount of liquid refrigerant is returned to the compressor 1 together with the refrigerating machine oil.

<Configuration of Indoor Unit>

The indoor unit 62 includes an indoor heat exchanger 6 that exchanges heat with a load-side medium, and an indoor fan 32 that transports the load-side medium, which is indoor air. Hereunder, each of the devices constituting the indoor unit 62 will be described by turns.

(Indoor Heat Exchanger)

The indoor heat exchanger 6 is for example a fin tube heat exchanger, and exchanges heat between the load-side medium, namely indoor air, supplied from the indoor fan 32 and the refrigerant. The load-side medium subjected to heat exchange with the refrigerant in the indoor heat exchanger 6 is not limited to indoor air, but for example water or anti-freeze fluid may be employed as heat source. In this case, a plate heat exchanger is employed as the indoor heat exchanger 6, and a pump is employed as the heat source-side transport device, instead of the indoor fan 32.

(Connection Pipe)

The liquid pipe 5 and the gas pipe 7 are connection pipes connecting between the outdoor unit 61 and the indoor unit 62, and have a predetermined length required for the connection. In general, the gas pipe 7 is larger in pipe diameter than the liquid pipe 5. The liquid pipe 5 is provided between an outdoor unit liquid pipe joint 11 of the outdoor unit 61 and an indoor unit liquid pipe joint 13 of the indoor unit 62, and the gas pipe 7 is provided between an outdoor unit gas pipe joint 12 of the outdoor unit 61 and an indoor unit gas pipe joint 14 of the indoor unit 62. By providing thus the liquid pipe 5 and the gas pipe 7 to connect between the outdoor unit 61 and the indoor unit 62, a refrigerant circuit 20 is constituted in which the refrigerant circulates through the compressor 1, the four-way valve 8, the indoor heat exchanger 6, the expansion valve 3, the outdoor heat exchanger 2, the four-way valve 8, and the accumulator 9 in the mentioned order.

<Sensors and Controller>

Hereunder, sensors and the controller 50 provided in the refrigeration cycle apparatus 100 will be described.

In the outdoor unit 61, a discharge temperature sensor 41 that detects the temperature of the refrigerant discharged from the compressor 1 (hereinafter, discharge temperature) is provided on the discharge side of the compressor 1. In addition, an outdoor heat exchanger saturation temperature sensor 42 that detects the temperature of the refrigerant flowing in the outdoor heat exchanger 2 (i.e., refrigerant temperature corresponding to condensation temperature in the cooling operation or evaporation temperature in the heating operation) is provided in the outdoor heat exchanger 2. Further, an outdoor heat exchanger temperature sensor 43 that detects the temperature of the refrigerant is provided on the liquid side of the outdoor heat exchanger 2.

The outdoor heat exchanger 2 serves as a condenser (radiator) in the cooling operation, and the degree of subcooling (SC) at the outlet of the condenser in the cooling operation can be obtained by subtracting the value detected by the outdoor heat exchanger saturation temperature sensor 42 from the value detected by the outdoor heat exchanger temperature sensor 43. Thus, the outdoor heat exchanger saturation temperature sensor 42 and the outdoor heat exchanger temperature sensor 43 constitute a subcooling degree detection device. Here, the subcooling degree detection device may be differently constituted. For example, a sensor that detects the discharge pressure of the refrigerant from the compressor 1 may be provided, and the degree of subcooling may be obtained by subtracting refrigerant saturated gas temperature converted from the value detected by the pressure sensor from the value detected by the outdoor heat exchanger temperature sensor 43.

In the indoor unit 62, an indoor heat exchanger saturation temperature sensor 44 that detects the temperature of the refrigerant flowing in the indoor heat exchanger 6 (i.e., refrigerant temperature corresponding to evaporation temperature in the cooling operation or condensation temperature in the heating operation) is provided in the indoor heat exchanger 6. In addition, an indoor heat exchanger temperature sensor 45 that detects the temperature of the refrigerant is provided on the liquid side of the indoor heat exchanger 6.

The indoor heat exchanger 6 serves as a condenser (radiator) in the heating operation, and the degree of subcooling (SC) at the outlet of the condenser in the heating operation can be obtained by subtracting the value detected by the indoor heat exchanger saturation temperature sensor 44 from the value detected by the indoor heat exchanger temperature sensor 45. Thus, the indoor heat exchanger saturation temperature sensor 44 and the indoor heat exchanger temperature sensor 45 constitute a subcooling degree detection device. Here, the subcooling degree detection device may be differently constituted. For example, a sensor that detects the discharge pressure of the refrigerant from the compressor 1 may be provided, and the degree of subcooling may be obtained by subtracting refrigerant saturated gas temperature converted from the value detected by the pressure sensor from the value detected by the indoor heat exchanger temperature sensor 45.

The controller 50 is constituted of a microcomputer and includes a CPU, a RAM, and a ROM, the ROM containing a control program and programs for performing processes according to flowcharts to be subsequently described. The controller 50 controls the compressor 1, the expansion valve 3, the outdoor fan 31, and the indoor fan 32 on the basis of the detection values from the sensors. The controller 50 also switches the four-way valve 8 so as to select either of the cooling operation and the heating operation. The controller 50 may be provided either in the outdoor unit 61 or in the indoor unit 62. Alternatively, the controller 50 may be divided into an indoor controller and an outdoor controller, so as to perform a linkage control.

The heating operation and the cooling operation of the refrigerant circuit 20 according to Embodiment 1 will be described hereunder.

<Flow, States, Etc. Of Refrigerant in Heating Operation>

In the heating operation, the four-way valve 8 is switched as indicated by solid lines in FIG. 1. The high-temperature/high-pressure refrigerant discharged from the compressor 1 passes through the four-way valve 8 and flows into the gas pipe 7 through the outdoor unit gas pipe joint 12. Since the gas pipe 7 has a predetermined length, the refrigerant which has flowed into the gas pipe 7 is depressurized owing to friction loss inside the gas pipe 7. Then the refrigerant flows into the indoor heat exchanger 6 of the indoor unit 62 through the indoor unit gas pipe joint 14. Since the indoor heat exchanger 6 serves as a radiator in the heating operation, the refrigerant which has entered the indoor heat exchanger 6 transmits heat through heat exchange with indoor air supplied by the indoor fan 32, thereby losing temperature and turning into subcooled liquid refrigerant, and flows out of the indoor heat exchanger 6.

The liquid refrigerant which has flowed out of the indoor heat exchanger 6 flows into the liquid pipe 5 through the indoor unit liquid pipe joint 13. The refrigerant which has entered the liquid pipe 5 is depressurized owing to the friction loss while passing through inside the liquid pipe, as in the gas pipe, and flows into the outdoor unit 61 through the outdoor unit liquid pipe joint 11. The refrigerant which has entered the outdoor unit 61 is further cooled through heat exchange with the refrigerant from the accumulator 9, in the refrigerant heat exchanger 4. The refrigerant cooled in the refrigerant heat exchanger 4 is depressurized by the expansion valve 3 thereby turning into gas-liquid two-phase refrigerant, and flows into the outdoor heat exchanger 2. Since the outdoor heat exchanger 2 serves as an evaporator in the heating operation, the refrigerant which has entered the outdoor heat exchanger 2 exchanges heat with outdoor air supplied by the outdoor fan 31 thus removing heat from the outdoor air and being evaporated, and flows out of the outdoor heat exchanger 2 in a state of saturated gas, or high-quality gas-liquid two-phase refrigerant.

The refrigerant which has flowed out of the outdoor heat exchanger 2 passes through the four-way valve 8 and flows into the accumulator 9. In the accumulator 9, the gas-liquid two-phase refrigerant is separated into gas refrigerant and liquid refrigerant, and the gas refrigerant is sucked into the compressor 1.

<Working of Refrigerant in Cooling Operation>

The four-way valve 8 is switched so that lines indicated as broken in the four-way valve 8 of FIG. 1 are connected in the cooling operation instead of the connections indicated by solid lines. The high-temperature/high-pressure refrigerant discharged from the compressor 1 passes through the four-way valve 8 and flows into the outdoor heat exchanger 2. The refrigerant flowing into the outdoor heat exchanger 2 is in general the same state as the high-temperature/high-pressure refrigerant discharged from the compressor 1. Since the outdoor heat exchanger 2 serves as a radiator in the cooling operation, the refrigerant which has entered the outdoor heat exchanger 2 transmits heat through heat exchange with outdoor air (atmospheric air) supplied by the outdoor fan 31, thereby losing temperature and turning into subcooled liquid refrigerant, and flows out of the indoor heat exchanger 6.

The refrigerant which has flowed out of the outdoor heat exchanger 2 is depressurized by the expansion valve 3 thereby turning into gas-liquid two-phase refrigerant, and flows into the liquid pipe 5 through the outdoor unit liquid pipe joint 11. Since the liquid pipe 5 has a predetermined length, the refrigerant which has flowed into the liquid pipe 5 is further depressurized owing to friction loss inside the liquid pipe 5, and then flows into the indoor heat exchanger 6 of the indoor unit 62 through the indoor unit liquid pipe joint 13. Since the indoor heat exchanger 6 serves as an evaporator in the cooling operation, the refrigerant which has entered the indoor heat exchanger 6 exchanges heat with indoor air supplied by the indoor fan 32 thus removing heat from the indoor air and being evaporated, and flows out of the indoor heat exchanger 6 in a state of saturated gas, or high-quality gas-liquid two-phase refrigerant.

The refrigerant which has flowed out of the indoor heat exchanger 6 flows into the gas pipe 7 through the indoor unit gas pipe joint 14. The gas pipe 7 has the same length as the liquid pipe 5, and therefore the refrigerant which has flowed into the gas pipe 7 is depressurized owing to friction loss while passing through the gas pipe, and flows into the accumulator 9 through the indoor unit gas pipe joint 14 and the four-way valve 8. In the accumulator 9, the gas-liquid two-phase refrigerant is separated into gas refrigerant and liquid refrigerant, and the gas refrigerant is sucked into the compressor 1.

<Relation Among Opening Degree of Expansion Valve 3 and Discharge Temperature, COP, Performance>

Figure 2:
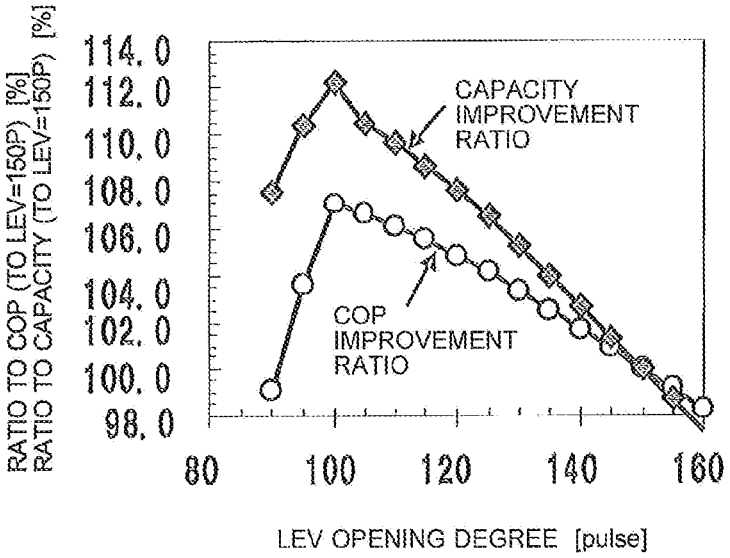
FIG. 2 is a graph showing a COP improvement rate and a capacity improvement rate with respect to an opening degree of an expansion valve 3.

FIG. 2 is a graph showing a COP improvement rate with respect to the opening degree of the expansion valve 3.

Figure 3:
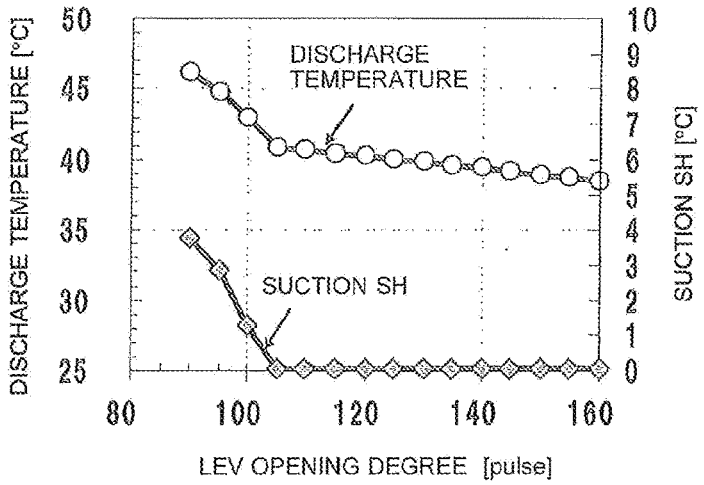
FIG. 3 is a graph showing discharge temperature and suction SH with respect to the opening degree of the expansion valve 3.

FIG. 3 is a graph showing discharge temperature and suction superheating (SH) with respect to the opening degree of the expansion valve 3.

When the opening degree of the expansion valve 3 is varied while the rotation speed of the compressor 1 is kept unchanged, at a certain opening degree the coefficient of performance (COP) improvement rate and capacity improvement rate become maximum. In the example shown in FIG. 2, the COP improvement rate and the capacity improvement rate become maximum when the opening degree of the expansion valve 3 is 100 pulses.

When the opening degree of the expansion valve 3 is set so as to maximize the COP improvement rate and the capacity improvement rate, the refrigerant sucked into the compressor 1 carries a slight degree of superheating (hereinafter, suction SH). For example, as shown in FIG. 3, at the opening degree of the expansion valve 3 that maximizes the COP improvement rate and the capacity improvement rate (100 pulses), the suction SH is approximately 1 K. In contrast, when the suction SH is excessively high the suction saturation temperature significantly drops, and therefore the COP declines, resulting in degraded COP improvement rate and capacity improvement rate.

In the refrigerant circuit 20, the degree of superheating at the outlet of the evaporator and the degree of superheating at the suction port of the compressor 1 (suction SH) are generally the same. Accordingly, the change of the suction SH and the change of the discharge temperature are correlated with each other, such that when the suction SH increases the discharge temperature also increases as shown in FIG. 3. In other words, the discharge temperature is correlated with the COP improvement rate and the capacity improvement rate. In addition, the discharge temperature drastically changes when the temperature of the refrigerant at the outlet of the evaporator reaches the level of superheated gas having a higher temperature than saturated gas (suction SH>0).

In other words, the amount of variation of the discharge temperature (hereinafter, discharge temperature variation rate) corresponding to a predetermined amount of variation of the opening degree (e.g., 1 pulse) of the expansion valve 3 differs between the cases of suction SH>0 and suction SH≤0.

Therefore, the opening degree of the expansion valve 3 (LPs) that makes the suction SH approximately 1 K, or turns the refrigerant at the outlet of the evaporator into saturated gas can be searched on the basis of the amount of variation of the discharge temperature resultant from the variation of the opening degree of the expansion valve 3. In other words, it becomes possible to search the opening degree of the expansion valve 3 (LPm) and a target discharge temperature (Tdm) that achieve the maximum COP improvement rate and capacity improvement rate.

Accordingly, in Embodiment 1 the opening degree to be set to the expansion valve 3 is determined by detecting the amount of variation of the discharge temperature resultant from the variation of the opening degree of the expansion valve 3 made during the operation of the refrigeration cycle apparatus 100.

<Control Operation>

Figure 4:
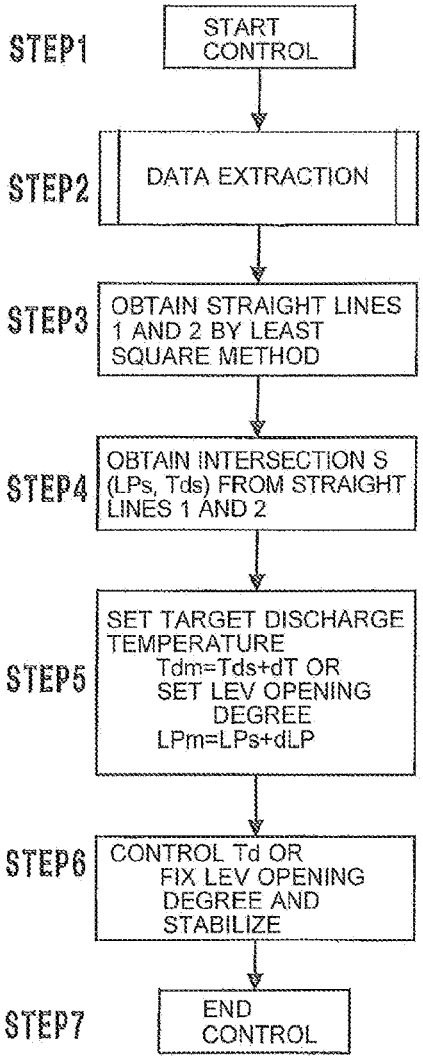
FIG. 4 is a flowchart showing a control operation performed by the refrigeration cycle apparatus according to Embodiment 1 of the present invention.

FIG. 4 is a flowchart showing a control operation performed by the refrigeration cycle apparatus according to Embodiment 1 of the present invention. Steps in FIG. 4 are described hereafter.

(Step 1)

The controller 50 starts the control operation to optimize the opening degree of the expansion valve 3 when a start condition is satisfied while the refrigeration cycle apparatus 100 is performing the heating operation or cooling operation.

It is preferable to start the control when the operation of the refrigeration cycle is stabilized as far as possible, in order to accurately determine the discharge temperature.

(Start Condition)

For example, [(a) or (b)] and (c) cited below may be specified as start conditions.

(a) When the amount of variation of the discharge temperature is stabilized within a predetermined range (e.g., ±1 K) for a predetermined time (e.g., 5 minutes)

(b) When the rotation speed of the compressor 1, the rotation speed of the outdoor fan 31, and the rotation speed of the indoor fan 32 are fixed (controlled to a constant level)

(c) When a first predetermined time (e.g., 20 minutes) has elapsed after the compressor 1 is activated Here, it is preferable that the suction SH is equal to or higher than 0 (e.g., 5K), because when surplus refrigerant is present in the accumulator 9 in the operation status before the start of the control, the variation of the discharge temperature is retarded. Accordingly, an initial opening degree that makes the suction SH equal to or higher than 0 (e.g., suction SH>5K) regardless of the operation status is stored in advance. Then the opening degree of the expansion valve 3 in the initial stage of the operation of the refrigeration cycle apparatus 100 is set to the initial opening degree stored as above.

(Step 2)

The controller 50 performs data extraction. The details of the data extraction process will be described with reference to FIG. 5.

<Data Extraction>

Figure 5:
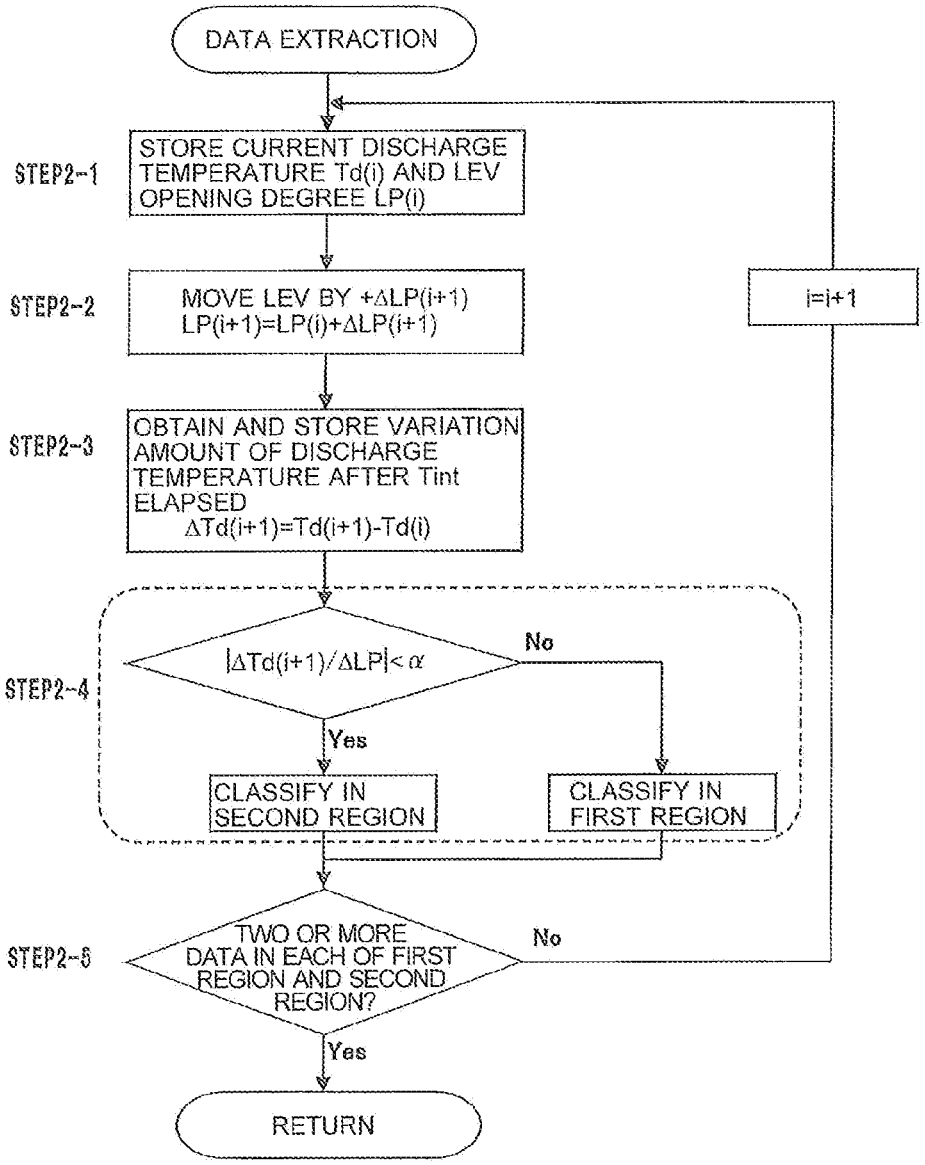
FIG. 5 is a flowchart showing a data extraction process performed by the refrigeration cycle apparatus according to Embodiment 1 of the present invention.

FIG. 5 is a flowchart showing the data extraction process performed by the refrigeration cycle apparatus according to Embodiment 1 of the present invention.

Hereunder, each step shown in FIG. 5 will be described.

Here, "i" denotes the number of times of the variation of the expansion valve 3, the initial value of which is 0.

(Step 2-1)

The controller 50 stores a current discharge temperature Td(i) detected by the discharge temperature sensor 41 and a current opening degree LP(i) set to the expansion valve 3.

(Step 2-2)

The controller 50 sets the current opening degree LP(i) of the expansion valve 3 to an opening degree LP(i+1) changed by an amount of variation ΔLP(i+1). The value ΔLP may be a fixed opening degree or several percent of the current opening degree.

(Step 2-3)

The controller 50 computes the difference between the discharge temperature Td(i) stored in STEP 2-1 and the discharge temperature Td(i+1) after the variation of the expansion valve 3 after a predetermined time Tint has elapsed, and stores the difference as amount of variation of the discharge temperature ΔTd(i+1).

(Step 2-4)

The controller 50 computes the discharge temperature variation rate R(i+1). The discharge temperature variation rate R(i+1) is the amount of variation ΔLP(i+1) of the opening degree of the expansion valve 3 to the ratio of the amount of variation of the discharge temperature ΔTd(i+1), and can be expressed as t equation (1) cited below.

[Math. 1]

$$R(i+1) = \frac{\Delta T_d(i+1)}{\Delta LP(i+1)} \quad (1)$$

The controller 50 determines whether the discharge temperature variation rate R(i+1) is smaller than a predetermined value α.

When the discharge temperature variation rate R(i+1) is not smaller than the predetermined value α, the information of the discharge temperature Td(i+1) and the opening degree LP(i+1) of the expansion valve 3 is stored, classified as information of a first region.

When the discharge temperature variation rate R(i+1) is smaller than the predetermined value α, the information of the discharge temperature Td(i+1) and the opening degree LP(i+1) of the expansion valve 3 is stored, classified as information of a second region.

Here, the predetermined value α is set to a value smaller than the discharge temperature variation rate R(i+1) in the case of suction SH>0, and larger than the discharge temperature variation rate R(i+1) in the case of suction SH≤0.

The predetermined value α differs depending on the capacity of the refrigeration cycle apparatus 100 and the opening degree characteristic of the expansion valve 3. The predetermined value α may be determined, for example, on the basis of experimental data or simulation, according to the type of the refrigeration cycle apparatus 100.

Figure 6:
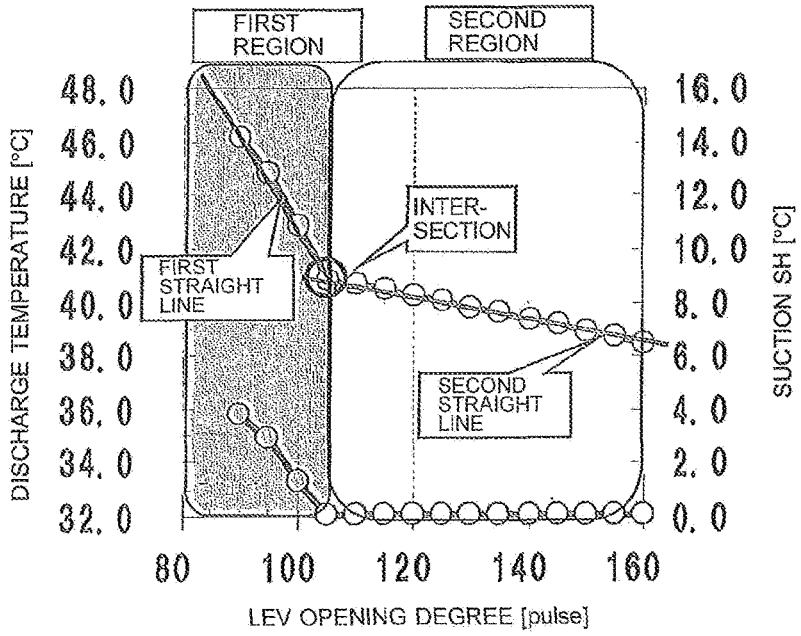
FIG. 6 is a graph based on FIG. 3, showing a first region and a second region, an approximation line and an intersection.

FIG. 6 is a graph based on FIG. 3, showing the first region and the second region, an approximation line and an intersection.

As shown in FIG. 6, when the discharge temperature variation rate R is larger than the predetermined value α, the information of the discharge temperature Td(i+1) and the opening degree LP(i+1) of the expansion valve 3 is classified as information of the first region corresponding to the case of suction SH>0.

When the discharge temperature variation rate R is smaller than the predetermined value α, the information of the discharge temperature Td(i+1) and the opening degree LP(i+1) of the expansion valve 3 is classified as information of the second region corresponding to the case of suction SH≤0.

(Step 2-5)

The controller 50 decides whether two pieces or more of the information of the discharge temperature Td(i+1) and the opening degree LP(i+1) of the expansion valve 3 classified in the first region have been stored, and whether two pieces or more of the information of the discharge temperature Td(i+1) and the opening degree LP(i+1) of the expansion valve 3 classified in the second region have been stored.

When two pieces each or more of the information of the first region and the information of the second region are not stored, the value "i" is incremented, and the operation returns to STEP 2-1 to repeat the above-described process.

When two pieces each or more of the information of the first region and the information of the second region are stored, the data extraction is finished and the operation proceeds to STEP 3.

Referring again to FIG. 4, the control operation will be described.

(Step 3)

The controller 50 obtains a relational expression in which the relation between the opening degree LP of the expansion valve 3 and the discharge temperature Td is approximated by a straight line (hereinafter, first straight line), on the basis of the information classified in the first region.

The controller 50 also obtains a relational expression in which the relation between the opening degree LP of the expansion valve 3 and the discharge temperature Td is approximated by a straight line (hereinafter, second straight line), on the basis of the information classified in the second region.

The first straight line and the second straight line are obtained, for example by a least square method, on the basis of the extracted information.

When the inclination of the first straight line is denoted by a1 and the segment by b2, and the inclination of the second straight line is denoted by a2 and the segment by b2, the first straight line and the second straight line can be expressed as equation (2).

[Math. 2]

$$y=a_1x+b_1$$

$$y=a_2x+b_2 \quad (2)$$

The calculation method of the relational expression in which the relation between the opening degree of the expansion valve 3 and the discharge temperature is approximated is not limited to the least square method but a desired regression analysis method may be employed. In addition, although the relation between the opening degree of the expansion valve 3 and the discharge temperature is approximated by the straight line (linear equation) in Embodiment 1, the present invention is not limited to this, and a multivariate function may be employed for the approximation.

Alternatively, the first straight line may be obtained on the basis of the information classified in the first region and indicating the opening degree of the expansion valve 3 larger than a minimum value of the opening degree of the expansion valve 3 classified in the second region. Also, the second straight line may be obtained on the basis of the information classified in the second region and indicating the opening degree of the expansion valve 3 larger than a maximum value of the opening degree of the expansion valve 3 classified in the first region.

Through the mentioned method, the relational expression of the first straight line and the second straight line approximating the relation between the opening degree LP of the expansion valve 3 and the discharge temperature Td can be more accurately obtained. For example, the discharge temperature variation rate R may be small when the opening degree of the expansion valve 3 is small depending on the operation status and detection error, in which case the information may be classified in the second region despite the suction SH being larger than 0. The mentioned method can exclude such information.

The relational expression of the first straight line corresponds to the "first approximation" in the present invention. The relational expression of the second straight line corresponds to the "second approximation" in the present invention.

(Step 4)

The controller 50 obtains the opening degree (LPs) of the expansion valve 3 and the discharge temperature (Tds) at the intersection between the first straight line and the second straight line.

LPs and Tds can be expressed as the following equations (3) and (4), on the basis of the equations (1) and (2) cited above.

[Math. 3]

$$LP_s = -\frac{b_1 - b_2}{a_1 - a_2} \tag{3}$$

[Math. 4]

$$T_{ds} = \frac{a_1 \cdot b_2 - a_2 \cdot b_1}{a_1 - a_2} \tag{4}$$

As shown in FIG. 6, the intersection between the first straight line and the second straight line generally coincides with the boundary between the first region and the second region. Accordingly, the opening degree (LPs) of the expansion valve 3 at the intersection between the first straight line and the second straight line is approximate to the opening degree of the expansion valve 3 that turns the refrigerant at the outlet of the evaporator into saturated gas. In addition, the discharge temperature (Tds) at the intersection between the first straight line and the second straight line is approximate to the temperature of the saturated gas.

(Step 5)

The controller 50 determines at least one of the target discharge temperature (Tdm) and the target opening degree (LPm) on the basis of the opening degree of the expansion valve 3 (LPs) and the discharge temperature (Tds) computed at STEP 4.

As described with reference to FIG. 2 and FIG. 3, it is when the refrigerant is slightly superheated (e.g., SH is approximately 1 K) that the COP improvement rate and the capacity improvement rate become maximum. In other words, the discharge temperature that maximizes the COP improvement rate and the capacity improvement rate may be slightly higher than the discharge temperature (Tds) at the intersection between the first straight line and the second straight line.

Therefore, the target discharge temperature (Tdm) which is the control target is determined by adding a predetermined correction value of temperature dT to the discharge temperature (Tds), as expressed by the following equation (5).

[Math. 5]

$$T_{dm} = T_{ds} + dT \tag{5}$$

In addition, the target opening degree (LPm) of the expansion valve 3 that maximizes the COP improvement rate and the capacity improvement rate can be obtained by equation (6) cited hereunder, on the basis of the relational expression of the first straight line.

A reason that the relational expression of the first straight line is employed is that the refrigerant of the target discharge temperature (Tdm) is slightly superheated (first region).

[Math. 6]

$$LP_m = -\frac{T_{dm} - b_1}{a_1} \tag{6}$$

Although in the mentioned process the target discharge temperature (Tdm) is first determined and then the target opening degree (LPm) is obtained on the basis of the target discharge temperature (Tdm), different approaches may be adopted.

For example, the target opening degree (LPm) may be determined by subtracting a predetermined correction value of opening degree dLP from the opening degree (LPs) of the expansion valve 3 at the intersection between the first straight line and the second straight line. Then the target opening degree (LPm) may be substituted in the relational expression of the first straight line, to thereby obtain the target discharge temperature (Tdm).

(Step 6)

The controller 50 sets the opening degree of the expansion valve 3 to the target opening degree (LPm).

Alternatively, the controller 50 sets the opening degree of the expansion valve 3 such that the discharge temperature detected by the discharge temperature sensor 41 accords with the target discharge temperature (Tdm).

(Step 7)

The controller 50 finishes the control operation when the end condition is satisfied.

(End Condition)

For example, when any one of (a), (b), and (c) cited below is satisfied, the above-described control is ended.

(a) When the target discharge temperature (Tdm) and the target opening degree (LPm) are determined.

(b) When the operation of the compressor 1 is stopped.

(c) When a control end signal instructing to end the control is received from an external device (e.g., remote controller).

Figure 7:
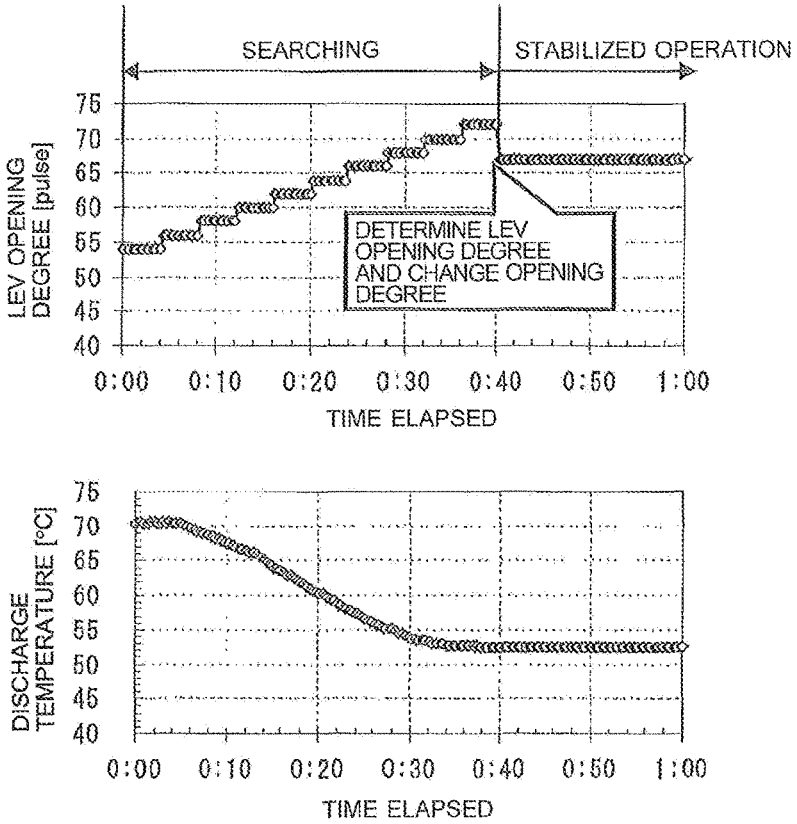
FIG. 7 is a graph showing time-series data of the control operation of the expansion valve 3 and discharge temperature, according to Embodiment 1 of the present invention.

FIG. 7 is a graph showing time-series data of the control operation of the expansion valve 3 and discharge temperature, according to Embodiment 1 of the present invention.

Through the foregoing control operation, the opening degree of the expansion valve 3 is gradually increased in increments of the amount of variation ΔLP with the lapse of time, and then set to the target opening degree (LPm). The discharge temperature gradually falls as the opening degree of the expansion valve 3 is increased, and is set to the target discharge temperature (Tdm) when the opening degree of the expansion valve 3 is set as above.

In Embodiment 1, as described thus far, the amount of variation of the discharge temperature ΔTd is obtained, and then the opening degree to be set to the expansion valve 3 is determined on the basis of the opening degree of the expansion valve 3 that causes a change in the discharge temperature variation rate R.

The mentioned arrangement enables the expansion valve 3 to be controlled so as to achieve a proper circulating condition, despite the refrigerant at the outlet of the condenser not being subcooled (SC), for example in a low-load operation.

In addition, utilizing the amount of variation of the discharge temperature ΔTd suppresses fluctuation of the COP and the capacity despite the error of detection values of the discharge temperature being individually different among a plurality of refrigeration cycle apparatuses manufactured, owing to different condition of installation of the discharge temperature sensor 41 and individual difference of the temperature sensor itself.

Further, recognizing the characteristics regarding the opening degree of the expansion valve 3 and the discharge temperature allows the opening degree of the expansion valve 3 to be set so as to realize the desired circulation status (e.g., COP and capacity becomes maximum) through a single item of determination of the opening degree. Such a method facilitates the operation status to be stabilized and improves the reproducibility of the operation status (capacity is kept from fluctuating), compared with the discharge temperature control based on a feedback control.

In Embodiment 1, further, the information acquired is classified into the information of the first region and the information of the second region on the basis of the discharge temperature variation rate R, and the relational expressions, of the first straight line and the second straight line are obtained on the basis of the information of respective regions. Then the opening degree (LPs) of the expansion valve 3 that turns the refrigerant at the outlet of the evaporator into saturated gas is obtained at the intersection between the first straight line and the second straight line.

Therefore, acquiring at least two pieces each of the information of the first region and the information of the second region enables the opening degree of the expansion valve 3 to be determined. Thus, the number of times to change the opening degree of the expansion valve 3 for searching the optimum opening degree can be reduced.

Embodiment 2

In Embodiment 2, a predicted value of the discharge temperature is obtained, and the information of the first region and the information of the second region are classified on the basis of the magnitude of the difference between the measured value and the predicted value of the discharge temperature.

Here, the configuration of the refrigeration cycle apparatus according to Embodiment 2 is the same as that of Embodiment 1.

<Predicted Value of Discharge Temperature>

An equation for predicting the discharge temperature resultant from the variation of the expansion valve 3 will be described.

When the compression process is regarded as polytropic change, the discharge temperature Td and the suction temperature Ts can be expressed as equation (7) cited below, on the basis of the discharge pressure Pd, the suction pressure Ps, and a polytropic index α.

[Math. 7]

$$(T_d + 273.15) = (T_s + 273.15)\cdot\left(\frac{P_d}{P_s}\right)^{\frac{\alpha-1}{\alpha}} \tag{7}$$

The relation between the discharge temperature Td* and the suction temperature Ts* resultant from the variation of the expansion valve 3 can be expressed as equation (8).

[Math. 8]

$$(T_d^* + 273.15) = (T_s^* + 273.15)\cdot\left(\frac{P_d}{P_s}\right)^{\frac{\alpha-1}{\alpha}} \tag{8}$$

Here, on the assumption that the discharge pressure, the suction pressure, and the polytropic index remain unchanged before and after the variation of the expansion valve 3, the following equation (9) can be obtained on the basis of the equations (7) and (8).

[Math. 9]

$$(T_d^* - T_d) = \beta\cdot(T_s^* - T_s)\cdot\left(\frac{P_d}{P_s}\right)^{\frac{\alpha-1}{\alpha}} \tag{9}$$

Here, the suction temperature Ts can be expressed as equation (10), on the basis of the suction saturation temperature ET and a suction superheating SHs.

[Math. 10]

$$T_s = ET + SH_s \tag{10}$$

Since the rotation speed of the compressor 1 is constant the discharge pressure and the suction pressure remain unchanged. Therefore, the discharge temperature and the suction SH can be expressed as equation (11), on the basis of the equations (9) and (10).

[Math. 11]

$$(T_d^* - T_d) = \beta\cdot((ET + SH_s^*) - (ET + SH_s))\cdot\left(\frac{P_d}{P_s}\right)^{\frac{\alpha-1}{\alpha}} \tag{11}$$

$$(T_d^* - T_d) = \beta\cdot(SH_s^* - SH_s)\cdot\left(\frac{P_d}{P_s}\right)^{\frac{\alpha-1}{\alpha}}$$

Thus, the amount of variation of the discharge temperature is proportional to the amount of variation of the suction SH.

In addition, the amount of variation ΔLP of the opening degree of the expansion valve 3 is correlated with the amount of variation of the suction superheating (suction SH), and hence can be expressed as equation (12).

[Math. 12]

$$\Delta LP = LP \cdot \lambda \cdot (SH_s - SH_s^*) \tag{12}$$

Here, λ is a coefficient.

Upon deforming the equation (12), the suction SH can be expressed as a function of the amount of variation ΔLP of the opening degree of the expansion valve 3, as equation (13).

[Math. 13]

$$SH_s^* - SH_s = (-1) \cdot \frac{1}{\lambda} \cdot \frac{\Delta LP}{LP - LP_0} \tag{13}$$

Here, LP denotes the current opening degree of the expansion valve 3, and $LP_0$ denotes a fully closed state.

On the basis of the equations (11) and (13), the discharge temperature realized when the opening degree of the expansion valve 3 is changed once can be expressed as equation (14).

[Math. 14]

$$(T_d^* - T_d) = \beta \cdot (-1) \cdot \frac{1}{\lambda} \cdot \left(\frac{P_d}{P_s}\right)^{\frac{\alpha-1}{\alpha}} \cdot \frac{\Delta LP}{LP - LP_0} = \beta \cdot K_0 \cdot \frac{\Delta LP}{LP - LP_0} \tag{14}$$

Here, $K_0$ can be expressed as equation (15).

[Math. 15]

$$K_0 = \left(-\frac{1}{\lambda}\right) \cdot \left(\frac{P_d}{P_s}\right)^{\frac{\alpha-1}{\alpha}} \tag{15}$$

On the basis of the equation (14), the predicted value of the amount of variation of the discharge temperature ΔTd realized when the opening degree of the expansion valve 3 is changed once can be expressed as equation (16) cited below. In addition, the predicted value of the discharge temperature realized when the opening degree of the expansion valve 3 is changed once can be expressed as equation (17).

[Math. 16]

$$\Delta Td^* = T_d^* - T_d = \beta \cdot K_0 \cdot \frac{\Delta LP}{LP - LP_0} \tag{16}$$

[Math. 17]

$$T_d^* = T_d + \beta \cdot K_0 \cdot \frac{\Delta LP}{LP - LP_0} \tag{17}$$

Here, β denotes a correction coefficient for the actual apparatus. A proportionality coefficient $K_0$ is a value determined depending on the discharge pressure Pd, suction pressure Ps, and so forth during the operation, as expressed by the equation (15). The correction coefficient β and the proportionality coefficient $K_0$ may be determined in advance through experiments or simulation, or computed on the basis of measurement results obtained during the operation. For example, the discharge pressure Pd and the suction pressure Ps may be computed on the basis of saturation temperature detected by the outdoor heat exchanger saturation temperature sensor 42 and the indoor heat exchanger saturation temperature sensor 44, to thereby compute the proportionality coefficient $K_0$ on the basis of the mentioned pressure values. Calculating thus the proportionality coefficient $K_0$ using the measurement results obtained during the operation enables the predicted value of the discharge temperature to be accurately determined.

<Difference between Measured Value and Predicted Value>

Figure 8:
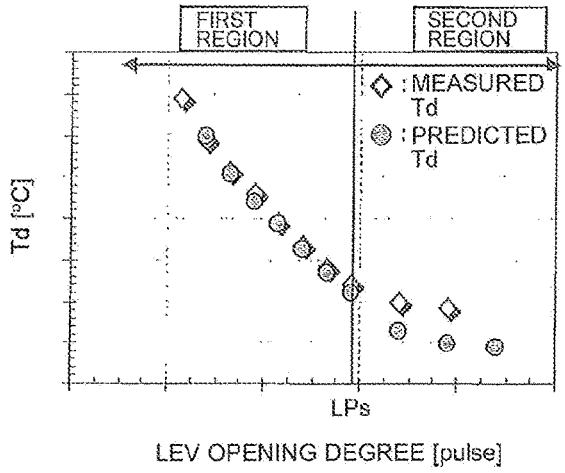
FIG. 8 is a graph showing a relation between the opening degree of the expansion valve 3 and a predicted value and a measured value of the discharge temperature, and a relation between the opening degree of the expansion valve 3 and COP.
Figure 8:
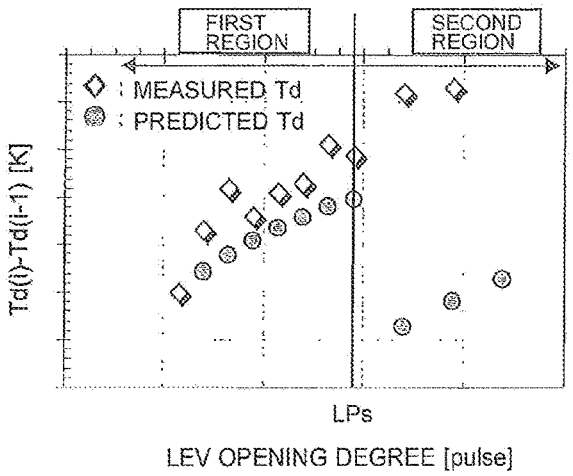
Figure 8:
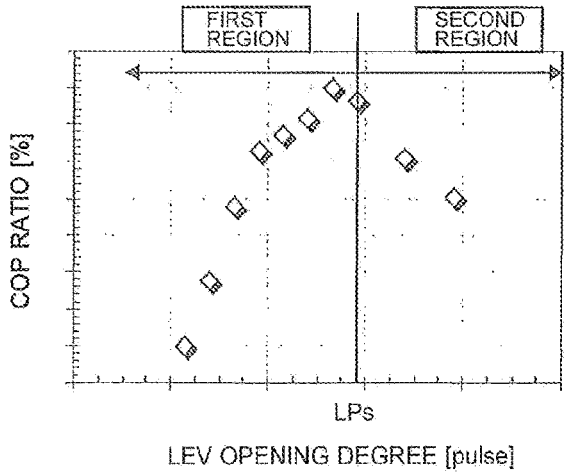

FIG. 8(*a*) is a graph showing a relation between the opening degree of the expansion valve 3 and the predicted value and the measured value of the discharge temperature. FIG. 8(*b*) is a graph showing a relation between the opening degree of the expansion valve 3 and the predicted value and the measured value of the amount of variation of the discharge temperature. FIG. 8(*c*) is a graph showing a relation between the opening degree of the expansion valve and the COP.

As shown in FIG. 8(*a*) and FIG. 8(*b*), the measured value and the predicted value of the discharge temperature generally agree with each other. However, when the opening degree of the expansion valve 3 is increased, the difference between the measured value and the predicted value becomes larger. In addition, as shown in FIG. 8(*c*) when the opening degree is set to a level that makes the difference between the measured value and the predicted value larger, the COP is degraded.

To be more detailed, when the refrigerant sucked into the compressor 1 is wet (suction SH<0), in other words in the second region where the opening degree of the expansion valve 3 is larger than LPs, the difference between the measured value and the predicted value becomes larger. When suction SH is higher than zero, in other words in the first region where the opening degree of the expansion valve 3 is lower than LPs, the difference between the measured value and the predicted value becomes smaller.

In Embodiment 2, accordingly, in the data extraction process the acquired information is classified as either of the information of the first region and the information of the second region, on the basis of the difference between the predicted discharge temperature Td(i+1)* and the discharge temperature Td(i) before the change.

<Control Operation>

Hereunder, the control operation according to Embodiment 2 will be described focusing on the difference from Embodiment 1.

The control operation is basically the same as the operation according to Embodiment 1 (FIG. 4). In Embodiment 2, the data extraction process of STEP 2 is different.

Figure 9:
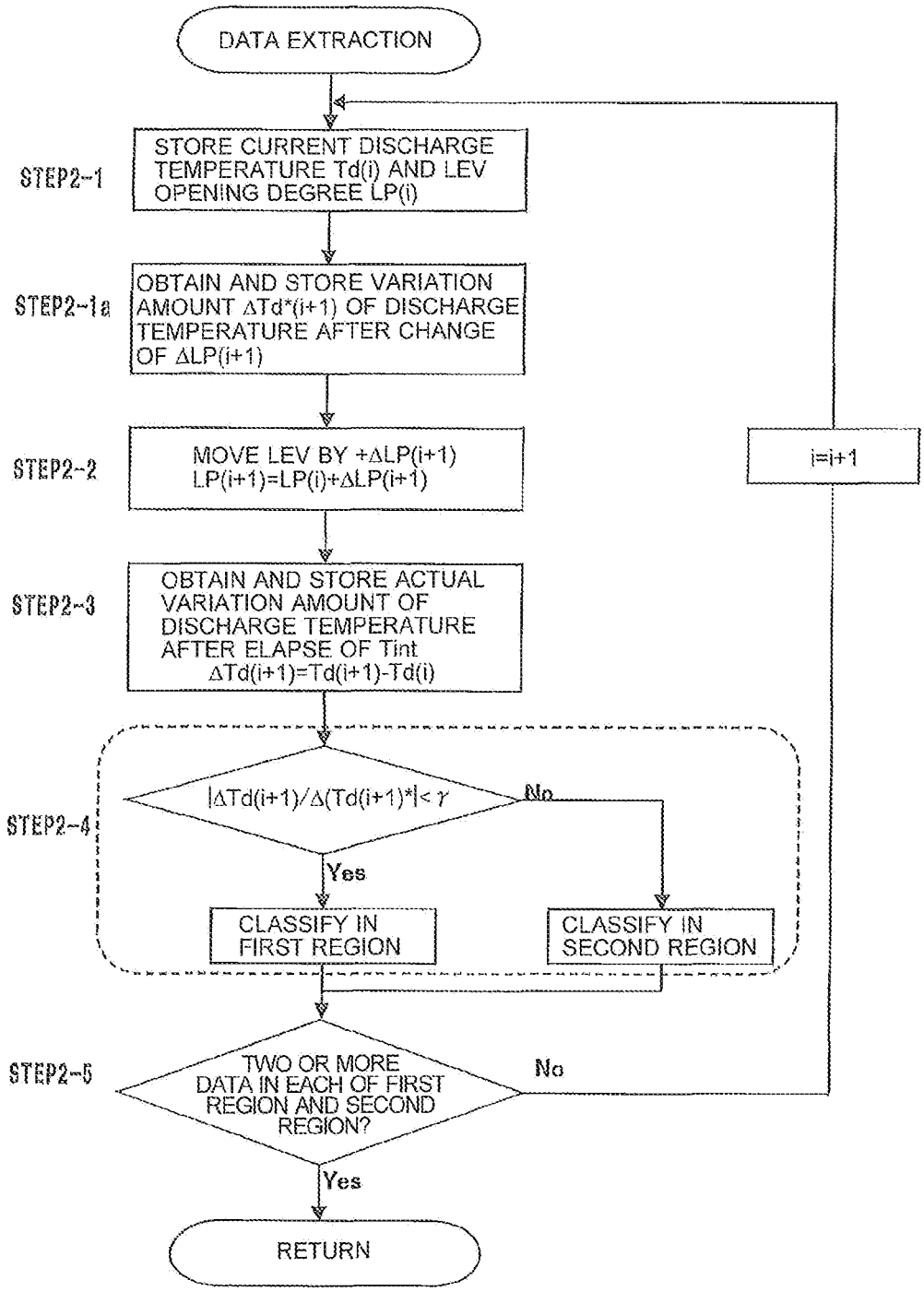
FIG. 9 is a flowchart showing a data extraction process performed by a refrigeration cycle apparatus according to Embodiment 2 of the present invention.

FIG. 9 is a flowchart showing the data extraction process performed by the refrigeration cycle apparatus according to Embodiment 2 of the present invention.

Each of the steps shown in FIG. 9 will be described below.

(Step 2-1)

The controller 50 stores the current discharge temperature Td(i) detected by the discharge temperature sensor 41 and the opening degree LP(i) currently set to the expansion valve 3.

(Step 2-1a)

The controller 50 substitutes the current discharge temperature Td(i), the current opening degree LP(i), and the opening degree amount of variation ΔLP(i+1) of the opening degree in the equation (17) cited above, to thereby compute the predicted value Td*(i+1) of the discharge temperature resultant from the variation of the opening degree of the expansion valve 3, using the following equation (18).

[Math. 18]

$$T_d^* = (i+1) = T_d(i) + \beta \cdot K_0 \cdot \frac{\Delta LP(i+1)}{LP(i) - LP_0} \tag{18}$$

Then the controller 50 computes the predicted value ΔTd*(i+1) of the amount of variation of the discharge temperature resultant from the variation of the opening degree of the expansion valve 3, using the following equation (19).

[Math. 19]

$$\Delta Td^* = T_d^*(i+1) - T_d(i) \tag{19}$$

(Step 2-2)

The controller 50 sets the current opening degree LP(i) of the expansion valve 3 to the opening degree LP(i+1) changed by an amount of variation ΔLP(i+1). The value ΔLP may be a fixed opening degree or several percent of the current opening degree.

(Step 2-3)

The controller 50 computes the difference between the discharge temperature Td(i) stored at STEP 2-1 and the measured value Td(i+1) of the discharge temperature after the variation of the expansion valve 3 after a predetermined time Tint has elapsed, and stores the difference as measured value ΔTd(i+1) of the amount of variation of the discharge temperature.

(Step 2-4)

The controller 50 computes the ratio of the measured value ΔTd(i+1) of the amount of variation of the discharge temperature to the predicted value ΔTd*(i+1) of the amount of variation of the discharge temperature (hereinafter, error ratio).

The controller 50 then decides whether the error ratio is smaller than a predetermined value γ.

When the error ratio is not smaller than the predetermined value γ, the information of the discharge temperature Td(i+1) and the opening degree LP(i+1) of the expansion valve 3 is stored, classified as information of the first region.

When the error ratio is smaller than the predetermined value γ, the information of the discharge temperature Td(i+1) and the opening degree LP(i+1) of the expansion valve 3 is stored, classified as information of the second region.

Here, the predetermined value γ is set to a value smaller than the error ratio in the case of suction SH>0 and larger than the error ratio in the case of suction SH≤0. The error may be set, for example, to 20%.

The predetermined value γ differs depending on the capacity of the refrigeration cycle apparatus 100 and the opening degree characteristic of the expansion valve 3. The predetermined value γ may be determined, for example, on the basis of experimental data or simulation, according to the type of the refrigeration cycle apparatus 100.

(Step 2-5)

The controller 50 decides whether two pieces or more of the information of the discharge temperature Td(i+1) and the opening degree LP(i+1) of the expansion valve 3 classified in the first region have been stored, and whether two pieces or more of the information of the discharge temperature Td(i+1) and the opening degree LP(i+1) of the expansion valve 3 classified in the second region have been stored.

When two pieces each or more of the information of the first region and the information of the second region are not stored, the value "i" is increased, and the operation returns to STEP 2-1 to repeat the mentioned process.

When two pieces each or more of the information of the first region and the information of the second region are stored, the data extraction is finished and the operation proceeds to STEP 3.

The subsequent process is the same as in Embodiment 1.

As described above, in Embodiment 2 also the expansion valve 3 can be controlled so as to realize a proper circulation condition, and the same advantageous effects as those provided by Embodiment 1 can be attained.

In Embodiment 2, the information for approximation with the first straight line and the second straight line is classified by using the difference between the measured value and the predicted value of the discharge temperature, and therefore the same threshold (predetermined value γ) can be employed for the classification regardless that size of the expansion valve 3 (e.g., amount of variation of flow drag coefficient per pulse) is different. Accordingly, there is no need to modify the control operation even when the expansion valve 3 incorporated in the refrigeration cycle apparatus 100 is replaced.

It is to be noted that in Embodiment 1 the ratio between the amount of variation of the discharge temperature and the amount of variation of the opening degree of the expansion valve 3 is employed, and therefore when the size of the expansion valve 3 is different the threshold (predetermined value α) has to be determined for each type of apparatus.

In addition, in Embodiment 2 the discharge temperature can be predicted, and therefore the expansion valve 3 can be quickly set to an appropriate opening degree through a protective control, provided that the refrigerant carries a suction SH (protective control).

Although the ratio between the predicted value ΔTd*(i+1) and the measured value ΔTd(i+1) is employed at STEP 2-4 in Embodiment 2, the present invention is not limited to such a method. The magnitude of the difference (absolute value) between the predicted value Td*(i+1) of the discharge temperature and the measured value Td(i+1) of the discharge temperature may be employed instead.

In the configuration of the refrigeration cycle apparatus 100 according to Embodiments 1 and 2, the outdoor unit 61 and the indoor unit 62 are connected to each other via the liquid pipe 5 and the gas pipe 7, however the liquid pipe 5 and the gas pipe 7 may be shortened, or excluded.

Figure 10:
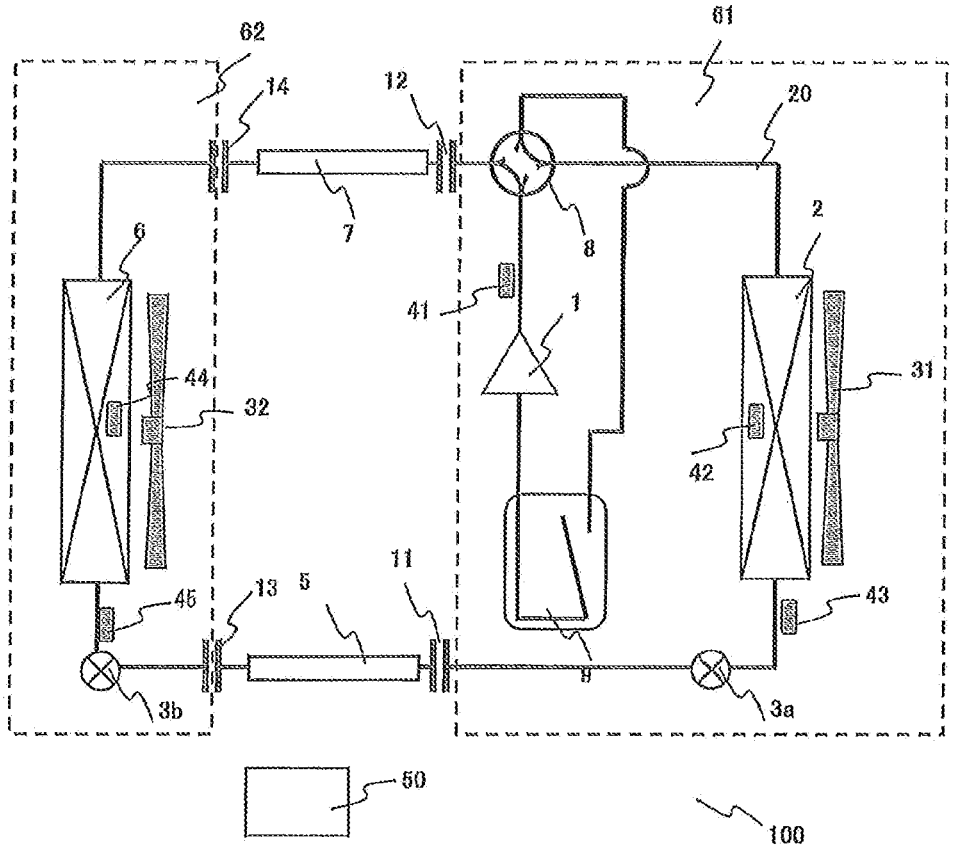
FIG. 10 is a schematic diagram showing a modification of the configuration of the refrigeration cycle apparatus according to Embodiment 1 or 2 of the present invention.
Figure 11:
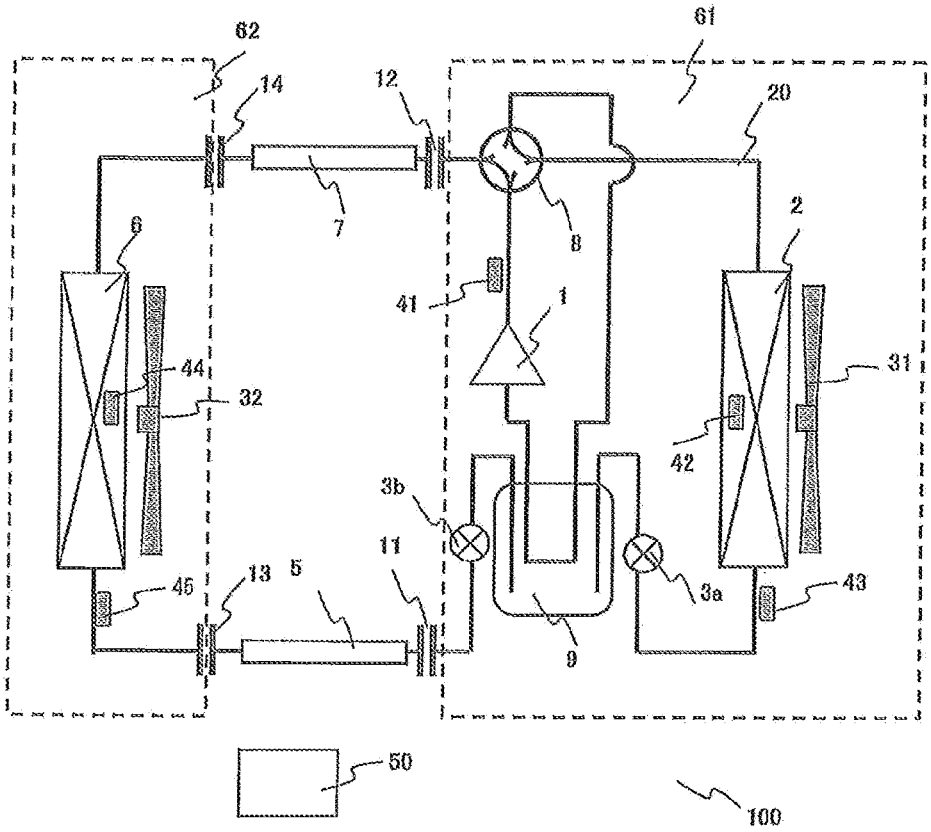
FIG. 11 is a schematic diagram showing another modification of the configuration of the refrigeration cycle apparatus according to Embodiment 1 or 2 of the present invention.
Figure 12:
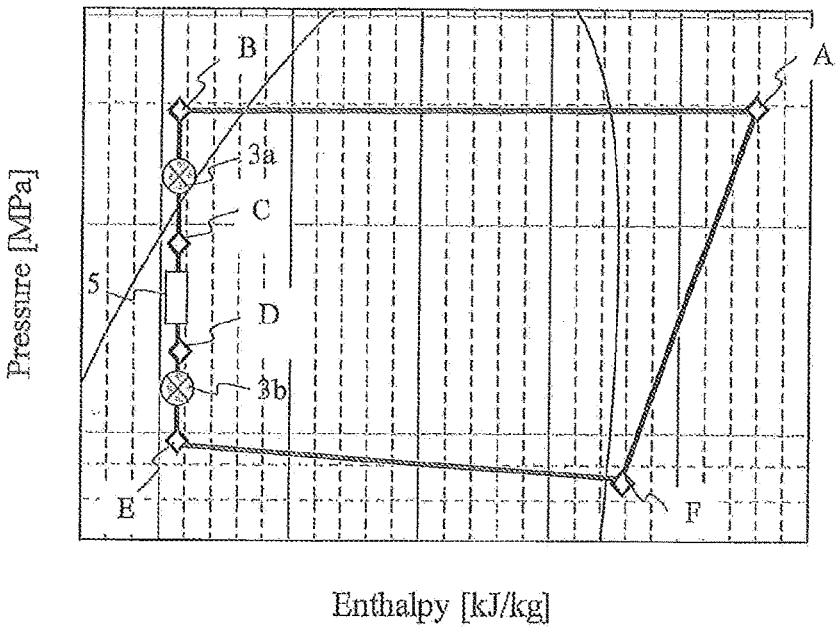
FIG. 12 is a P-h line graph of the refrigeration cycle apparatus shown in FIG. 10 and FIG. 11.

In the refrigeration cycle apparatus 100, the refrigerant circuit 20 may include two or more expansion valves connected in series. For example as shown in FIG. 10, an expansion valve 3*a* may be provided between the outdoor heat exchanger 2 and the liquid pipe 5, and an expansion valve 3*b* may be provided between the liquid pipe 5 and the indoor heat exchanger 6. Alternatively, the accumulator 9 may be located between the outdoor heat exchanger 2 and the liquid pipe 5 as shown in FIG. 11, so that the refrigerant in the accumulator 9 and the refrigerant in the suction-side pipe of the compressor 1 may exchange heat with each other, and the expansion valve 3*a* may be provided between the outdoor heat exchanger 2 and the accumulator 9 and the expansion valve 3*b* may be provided between the accumulator 9 and the liquid pipe 5. The depressurization process in the configuration shown in FIG. 10 and FIG. 11 is performed in each of the expansion valve 3*a* and the expansion valve 3*b* as indicated between B and E in FIG. 12. When the refrigerant circuit 20 thus includes two or more expansion valves connected in series, one to be controlled may be selected out of the two or more expansion valves, and the opening degree of other expansion valves may be fixed. With such an arrangement, the same control operation can be performed.

When the refrigerant circuit 20 thus includes two or more expansion valves connected in series, in addition, the opening degree to be set to the plurality of expansion valves may be determined on the basis of the flow path resistance of the respective expansion valves. To be more detailed, the combined flow path resistance R created when two or more expansion valves are connected in series in the refrigerant circuit 20 can be expressed as equation (20), where Rn (n=1, 2, . . . N) denotes the flow path resistance of each of the expansion valve 3*n* (n=1, 2, . . . N).

[Math. 20]

$$R = \left(\frac{1}{R_1} + \frac{1}{R_2} + \dots \frac{1}{R_N}\right)^{-1} \tag{20}$$

Here, for example the Cv value, or the opening degree, of the expansion valve 3*n* may be employed as the flow path resistance R. Alternatively, the flow path resistance Rn may be determined in consideration of the flow path resistance of the component devices such as the connection pipe and the heat exchanger.

Upon replacing the relation between the combined flow path resistance R and the discharge temperature for the relation between the opening degree of the expansion valve 3 and the discharge temperature shown in FIG. 3, it becomes possible to perform the control operation in the same way as the case where a single expansion valve 3 is provided.

Further, according to Embodiments 1 and 2, the opening degree (LPm) of the expansion valve 3 and the target discharge temperature (Tdm) that maximize the COP improvement rate and the capacity improvement rate are searched by using the detection value of the discharge temperature. However, in addition to the discharge temperature the degree of subcooling condenser, the degree of superheating at the outlet of the evaporator, and the suction temperature or suction SH of the compressor 1 may be employed. In this case, the deviation of representative temperature is employed, and therefore an impact of detection error originating from fluctuation of condition of installation on the performance can be suppressed. In addition, when the current control target is the degree of subcooling at the outlet of the condenser, the need to change the control target is eliminated and the control arrangement can be simplified.

REFERENCE SIGNS LIST

1: compressor, 2: outdoor heat exchanger, 3: expansion valve, 4: refrigerant heat exchanger, 5: liquid pipe, 6: indoor heat exchanger, 7: gas pipe, 8: four-way valve, 9: accumulator, 11: outdoor unit liquid pipe joint, 12: outdoor unit gas pipe joint, 13: indoor unit liquid pipe joint, 14: indoor unit gas pipe joint, 20: refrigerant circuit, 31: outdoor fan, 32: indoor fan, 41: discharge temperature sensor, 42: outdoor heat exchanger saturation temperature sensor, 43: outdoor heat exchanger temperature sensor, 44: indoor heat exchanger saturation temperature sensor, 45: indoor heat exchanger temperature sensor, 50: controller, 61: outdoor unit, 62: indoor unit, 100 refrigeration cycle apparatus

The invention claimed is:

1. A refrigeration cycle apparatus including a compressor, a condenser, an expansion valve having variable opening degree, and an evaporator which are connected in a loop via pipes so as to allow refrigerant to circulate therein, the apparatus comprising:

a temperature sensor to detect a discharge temperature of the refrigerant discharged from the compressor; and a controller configured to control the opening degree of the expansion valve, wherein the controller obtains an amount of variation (ΔTd) of the discharge temperature resulting from varying the opening degree of the expansion valve, obtains a ratio of the amount of variation (ΔTd) of the discharge temperature to an amount of variation (ΔLP) of the opening degree of the expansion valve, and determines an opening degree to be set to the expansion valve based on a value of the opening degree, at which the ratio changes, of the expansion valve.

2. A refrigeration cycle apparatus including a compressor, a condenser, an expansion valve having variable opening degree, and an evaporator which are connected in a loop via pipes so as to allow refrigerant to circulate therein, the apparatus comprising:

a temperature sensor to detect a discharge temperature of the refrigerant discharged from the compressor; and a controller configured to increase the opening degree of the expansion valve by an amount of variation (ΔLP), and change the opening degree of the expansion valve to a predetermined opening degree after a ratio of an amount of variation (ΔTd) of the discharge temperature to the amount of variation (ΔLP) reaches a predetermined value, wherein the controller obtains, based on the change of the ratio, the opening degree (LPs) of the expansion valve that turns a state of the refrigerant at an outlet of the evaporator into a saturated gas state, and determines an opening degree to be set to the expansion valve based on the opening degree (LPs) of the expansion valve.

3. The refrigeration cycle apparatus of claim 1, wherein the controller changes the opening degree of the expansion valve a plurality of times, acquires information of the opening degree of the expansion valve and the discharge temperature before the change and information of the opening degree of the expansion valve and the discharge temperature after the change, computes the ratio of the amount of variation (ΔTd) of the discharge temperature to the amount of variation (ΔLP) of the opening degree of the expansion valve for each time of changing the opening degree, classifies the acquired information into information of a first region and information of a second region based on magnitude of the ratio, obtains a first relational expression expressed by a first straight line, the first straight line expressing a relation between the opening degree of the expansion valve and the discharge temperature based on the information classified in the first region, obtains a second relational expression expressed by a second straight line, the second straight line expressing a relation between the opening degree of the expansion valve and the discharge temperature based on the information classified in the second region, and obtains the opening degree of the expansion valve at an intersection between the first straight line and the second straight line as the opening degree (LPs) of the expansion valve that turns a state of the refrigerant at an outlet of the evaporator into a saturated gas state, and determines the opening degree to be set to the expansion valve based on the opening degree (LPs) of the expansion valve.

4. The refrigeration cycle apparatus of claim 1, wherein the controller obtains a predicted value of the discharge temperature resultant from varying the opening degree of the expansion valve by a predetermined amount, utilizing information of the opening degree of the expansion valve and the discharge temperature at current time, and an equation prepared in advance, changes the opening degree of the expansion valve a plurality of times, acquires information of the opening degree of the expansion valve and of the discharge temperature before the change and information of the opening degree of the expansion valve and a measured value of the discharge temperature after the change, classifies the acquired information into information of a first region and information of a second region based on magnitude of difference between the measured value and the predicted value of the discharge temperature, obtains a first relational expression expressed by a first straight line, the first straight line expressing a relation between the opening degree of the expansion valve and the discharge temperature based on the information classified in the first region, obtains a second relational expression expressed by a first straight line, the first straight line expressing a relation between the opening degree of the expansion valve and the discharge temperature based on the information classified in the second region, and obtains the opening degree of the expansion valve at an intersection between the first straight line and the second straight line as the opening degree (LPs) of the expansion valve that turns a state of the refrigerant at an outlet of the evaporator into a saturated gas state, and determines the opening degree to be set to the expansion valve based on the opening degree (LPs) of the expansion valve.

5. The refrigeration cycle apparatus of claim 1, wherein the controller sets the expansion valve to an opening degree determined by subtracting a predetermined correction value of opening degree from the opening degree (LPs) of the expansion valve that turns a state of the refrigerant at the outlet of the evaporator into a saturated gas state.

6. The refrigeration cycle apparatus of claim 3, wherein the controller determines as target discharge temperature a temperature obtained by adding a predetermined correction value of temperature to the discharge temperature at an intersection between the first approximation and the second approximation, and sets the opening degree of the expansion valve so that the discharge temperature agrees with the target discharge temperature.

7. The refrigeration cycle apparatus of claim 3, wherein the controller obtains the first approximation based on the information classified in the first region and indicating the opening degree of the expansion valve larger than a minimum value of the opening degree of the expansion valve classified in the second region.

8. The refrigeration cycle apparatus of claim 3, wherein the controller obtains the second approximation based on the information classified in the second region and indicating the opening degree of the expansion valve larger than a maximum value of the opening degree of the expansion valve classified in the first region.

9. The refrigeration cycle apparatus of claim 1, wherein the controller starts a control operation for determining an opening degree to be set to the expansion valve when a predetermined first time has elapsed after the compressor is activated, and the amount of variation (ΔTd) of the discharge temperature is stabilized within a predetermined range or a rotation speed of the compressor is fixed.

10. A control method of a refrigeration cycle apparatus including a compressor, a condenser, an expansion valve with variable opening degree, and an evaporator which are connected in a loop via a pipe so as to allow refrigerant to circulate therein, the method comprising:

obtaining the amount of variation (ΔTd) of the discharge temperature resulting from varying an opening degree of the expansion valve, obtaining a ratio of the amount of variation (ΔTd) of the discharge temperature to an amount of variation (ΔLP) of the opening degree of the expansion valve, and determining an opening degree to be set to the expansion valve based on a value of the opening degree, at which the ratio changes, of the expansion valve.

11. The refrigeration cycle apparatus of claim 1, wherein the controller is configured to increase the opening degree of the expansion valve by an amount of variation (ΔLP), and change the opening degree of the expansion valve to a predetermined opening degree after the ratio of an amount of variation (ΔTd) of the discharge temperature to the amount of variation (ΔLP) reaches a predetermined value.

12. The refrigeration cycle apparatus of claim 1, wherein the controller obtains, based on the change of the ratio, the opening degree (LPs) of the expansion valve that turns a state of the refrigerant at an outlet of the evaporator into a saturated gas state, and determines the opening degree to be set to the expansion valve based on the opening degree (LPs) of the expansion valve.

* * * * *